US011920795B2

(12) United States Patent
Borys

(10) Patent No.: US 11,920,795 B2
(45) Date of Patent: Mar. 5, 2024

(54) FUEL INJECTION DEVICE, NOZZLE, AND COMBUSTOR INCLUDING THE SAME

(71) Applicant: DOOSAN ENERBILITY CO., LTD, Changwon-si (KR)

(72) Inventor: Shershnyov Borys, Changwon (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 60 days.

(21) Appl. No.: 17/242,462

(22) Filed: Apr. 28, 2021

(65) Prior Publication Data

US 2021/0396390 A1 Dec. 23, 2021

(30) Foreign Application Priority Data

Jun. 22, 2020 (KR) ..... 10-2020-0075779

(51) Int. Cl.

| | |
|---|---|
| ***F23R 3/00*** | (2006.01) |
| ***F23D 11/38*** | (2006.01) |
| ***F23R 3/28*** | (2006.01) |
| ***F23R 3/34*** | (2006.01) |

(52) U.S. Cl.

CPC ..... *F23R 3/343* (2013.01); *F23D 11/383* (2013.01); *F23R 3/286* (2013.01); *F23D 2206/10* (2013.01); *F23D 2900/14021* (2013.01)

(58) Field of Classification Search

None

See application file for complete search history.

(56) References Cited

U.S. PATENT DOCUMENTS

| | | | | |
|---|---|---|---|---|
| 6,267,583 | B1 * | 7/2001 | Mandai | F23D 23/00 431/278 |
| 6,457,163 | B1 | 9/2002 | Yang | |
| 6,543,235 | B1 | 4/2003 | Crocker | |
| 8,347,631 | B2 | 1/2013 | Bailey | |
| 9,400,104 | B2 * | 7/2016 | Low | F23D 11/383 |
| 2005/0223713 | A1 | 10/2005 | Ziminsky | |
| 2008/0265062 | A1 | 10/2008 | Brown | |
| 2009/0050710 | A1 | 2/2009 | Myers | |
| 2009/0178412 | A1 * | 7/2009 | Spytek | F23R 3/58 60/752 |
| 2010/0071374 | A1 * | 3/2010 | Fox | F23R 3/28 60/734 |

(Continued)

FOREIGN PATENT DOCUMENTS

| | | | |
|---|---|---|---|
| JP | 2015535583 | A | 12/2015 |
| JP | 2017521624 | A | 8/2017 |

(Continued)

OTHER PUBLICATIONS

KR decision to Grant dated Sep. 24, 2021.

*Primary Examiner* — Edwin Kang

(74) *Attorney, Agent, or Firm* — Harvest IP Law, LLP

(57) ABSTRACT

A nozzle, a combustor, and a gas turbine, which are capable of atomizing fuel efficiently, are provided. A fuel injection device for the combustor may include a plurality of guide channels connected to a pilot fuel passage through which fuel is supplied, an injection chamber connected to the plurality of guide channels, the fuel being merged in the injection chamber, and an injection hole formed at a tip of the injection chamber to inject the fuel, and the injection chamber may include a decompression space to drop a pressure therein.

18 Claims, 7 Drawing Sheets

(56) References Cited

U.S. PATENT DOCUMENTS

| | | | | |
|---|---|---|---|---|
| 2011/0067379 | A1 | 3/2011 | Khan | |
| 2015/0000285 | A1 | 1/2015 | Deiss | |
| 2017/0363293 | A1* | 12/2017 | Grooms ..... | F02C 7/222 |
| 2018/0003385 | A1 | 1/2018 | Rodrigues | |

FOREIGN PATENT DOCUMENTS

| | | | |
|---|---|---|---|
| KR | 1020170140920 | A | 12/2017 |
| KR | 20190099916 | A | 8/2019 |

* cited by examiner

FUEL INJECTION DEVICE, NOZZLE, AND COMBUSTOR INCLUDING THE SAME

CROSS-REFERENCE TO RELATED APPLICATION(S)

This application claims priority to Korean Patent Application No. 10-2020-0075779, filed on Jun. 22, 2020 the disclosure of which is incorporated herein by reference in its entirety.

BACKGROUND

Technical Field

Apparatuses and methods consistent with exemplary embodiments relate to a fuel injection device, a nozzle, and a combustor including the same.

Description of the Related Art

A gas turbine is a power engine that mixes air compressed by a compressor with fuel for combustion and rotates a turbine with hot gas produced by the combustion. The gas turbine is used to drive a generator, an aircraft, a ship, a train, etc.

This gas turbine includes a compressor, a combustor, and a turbine. The compressor sucks and compresses outside air, and transmits the compressed air to the combustor. The air compressed by the compressor is in a state of high-pressure and high-temperature. The combustor mixes the compressed air compressed by the compressor with fuel and burns a mixture thereof to produce combustion gas. Turbine blades in the turbine are rotated by the combustion gas supplied form the combustor, thereby generating power. The generated power is used in various fields, such as generating electric power and actuating machines.

Fuel is injected through nozzles installed in each combustor section of the combustor, and the nozzles inject liquid fuel. These nozzles include liquid atomization nozzles that spray a quantity of fuel into a combustion chamber. Each of the nozzles needs to have a simple structure, and it should be able to atomize fuel efficiently. In addition, if an outlet of the nozzle has a small diameter, the flow rate of fuel decreases, while if the outlet of the nozzle has a large diameter, it is difficult to atomize fuel due to an increase in size of fuel particles.

SUMMARY

Aspects of one or more exemplary embodiments provide a fuel injection device, a nozzle, and a combustor, which are capable of atomizing fuel efficiently.

Additional aspects will be set forth in part in the description which follows and, in part, will become apparent from the description, or may be learned by practice of the exemplary embodiments.

According to an aspect of an exemplary embodiment, there is provided a fuel injection device including: a plurality of guide channels connected to a pilot fuel passage through which fuel is supplied, an injection chamber connected to the plurality of guide channels, the fuel being merged in the injection chamber, and an injection hole formed at a tip of the injection chamber to inject the fuel, wherein the injection chamber may include a decompression space to drop a pressure therein.

The plurality of guide channels may have a plurality of outlets connected to the injection chamber, and the decompression space may be located between the plurality of outlets.

The plurality of guide channels may be connected in a spiral form.

The fuel injection device may further include a flow guide forming the plurality of guide channels.

The flow guide may include a rod-shaped body and a spiral protrusion protruding from the body and connected in a spiral form.

The spiral protrusion may have a tip protruding further from the body.

The spiral protrusion may have a width that gradually increases outward.

The spiral protrusion may include a tail protrusion protruding further rearward from the body.

The decompression space may be defined at a tip of the flow guide.

The decompression space may be in a form of a curved arc.

The decompression space may have a larger outer radius of curvature than an inner radius of curvature.

The decompression space may have a cross section which is part of an ellipse.

Each of the plurality of outlets may be inclined with respect to a longitudinal direction of the flow guide.

The decompression space may be defined by a first groove having a first radius of curvature and a second groove having a second radius of curvature smaller than the first radius of curvature, the second groove being formed at a center of the first groove.

The decompression space may be defined by a first groove having an inclined surface and a second groove in a form of a curved arc, the second groove being formed at a center of the first groove.

According to an aspect of another exemplary embodiment, there is provided a combustor nozzle including: an outer tube, a first inner tube installed inside the outer tube to form an air passage with the outer tube therebetween, and a second inner tube installed inside the first inner tube to form a main fuel passage with the first inner tube therebetween, the second inner tube having a pilot fuel passage formed therein, and a fuel injection device installed in the second inner tube to inject fuel. The fuel injection device may include a plurality of guide channels connected to the pilot fuel passage through which fuel is supplied, an injection chamber connected to the plurality of guide channels, the fuel being merged in the injection chamber, and an injection hole formed at a tip of the injection chamber to inject the fuel. The injection chamber may include a decompression space to drop a pressure therein.

The plurality of guide channels may have a plurality of outlets connected to the injection chamber, and the decompression space may be located between the plurality of outlets.

The fuel injection device may further include a flow guide forming the plurality of guide channels, and the flow guide may include a rod-shaped body and a spiral protrusion protruding from the body and connected in a spiral form.

According to an aspect of another exemplary embodiment, there is provided a combustor including: a burner including a plurality of nozzles for injecting fuel and air, and a duct assembly coupled to one side of the burner to burn a mixture of the fuel and the air and transmit combustion gas to a turbine. Each of the plurality of nozzles may include an outer tube, a first inner tube installed inside the outer tube to form an air passage with the outer tube therebetween, a second inner tube installed inside the first inner tube to form a main fuel passage with the first inner tube therebetween, the second inner tube having a pilot fuel passage formed therein, and a fuel injection device installed in the second inner tube to inject fuel. The fuel injection device may include a plurality of guide channels connected to the pilot fuel passage through which fuel is supplied, an injection chamber connected to the plurality of guide channels, the fuel being merged in the injection chamber, and an injection hole formed at a tip of the injection chamber to inject the fuel. The injection chamber may include a decompression space to drop a pressure therein.

The guide channels may have a plurality of outlets connected to the injection chamber, and the decompression space may be located between the plurality of outlets.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
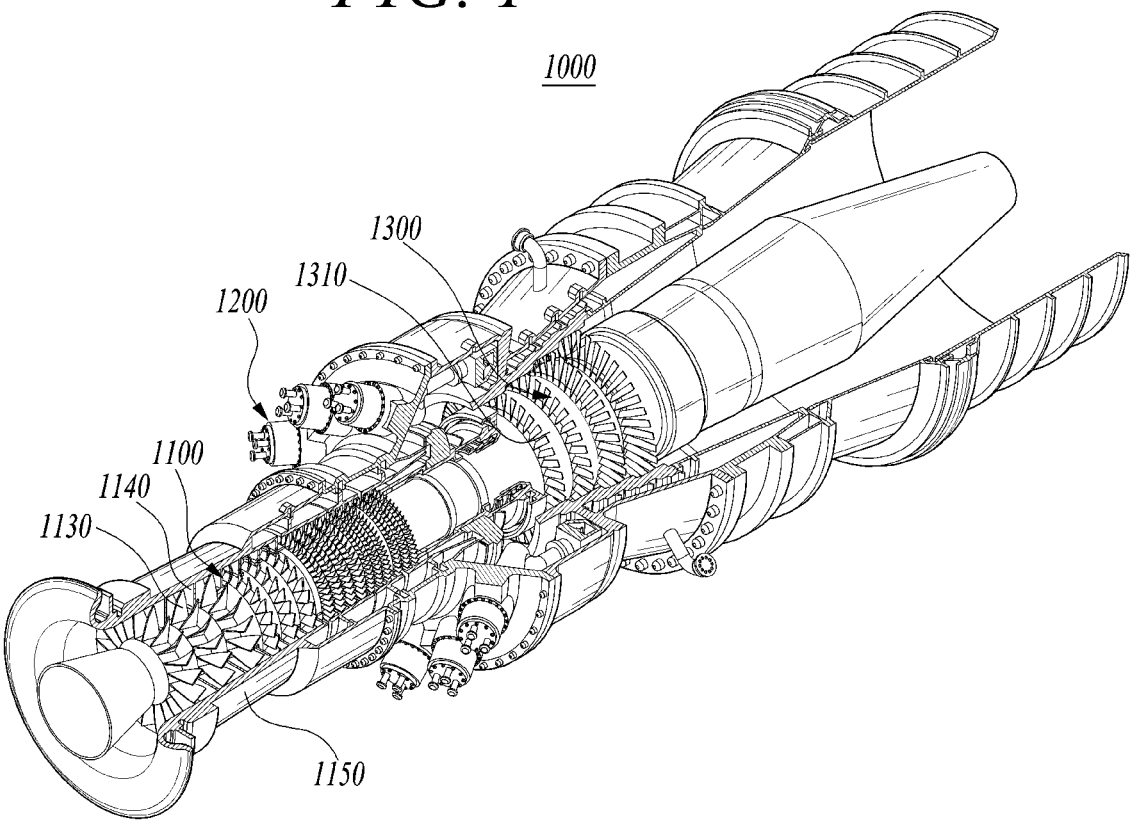
FIG. 1 is a view illustrating an interior of a gas turbine according to a first exemplary embodiment.

Various modifications and various embodiments will be described below in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

The terminology used herein is for the purpose of describing specific embodiments only and is not intended to limit the scope of the disclosure. The singular expressions "a", "an", and "the" are intended to include the plural expressions as well unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Exemplary embodiments will be described below in detail with reference to the accompanying drawings. It should be noted that like reference numerals refer to like parts throughout the various figures and exemplary embodiments. In certain embodiments, a detailed description of functions and configurations well known in the art may be omitted to avoid obscuring appreciation of the disclosure by a person of ordinary skill in the art. For the same reason, some components may be exaggerated, omitted, or schematically illustrated in the accompanying drawings.

Hereinafter, a gas turbine according to an exemplary embodiment will be described with reference to the accompanying drawings.

Figure 2:
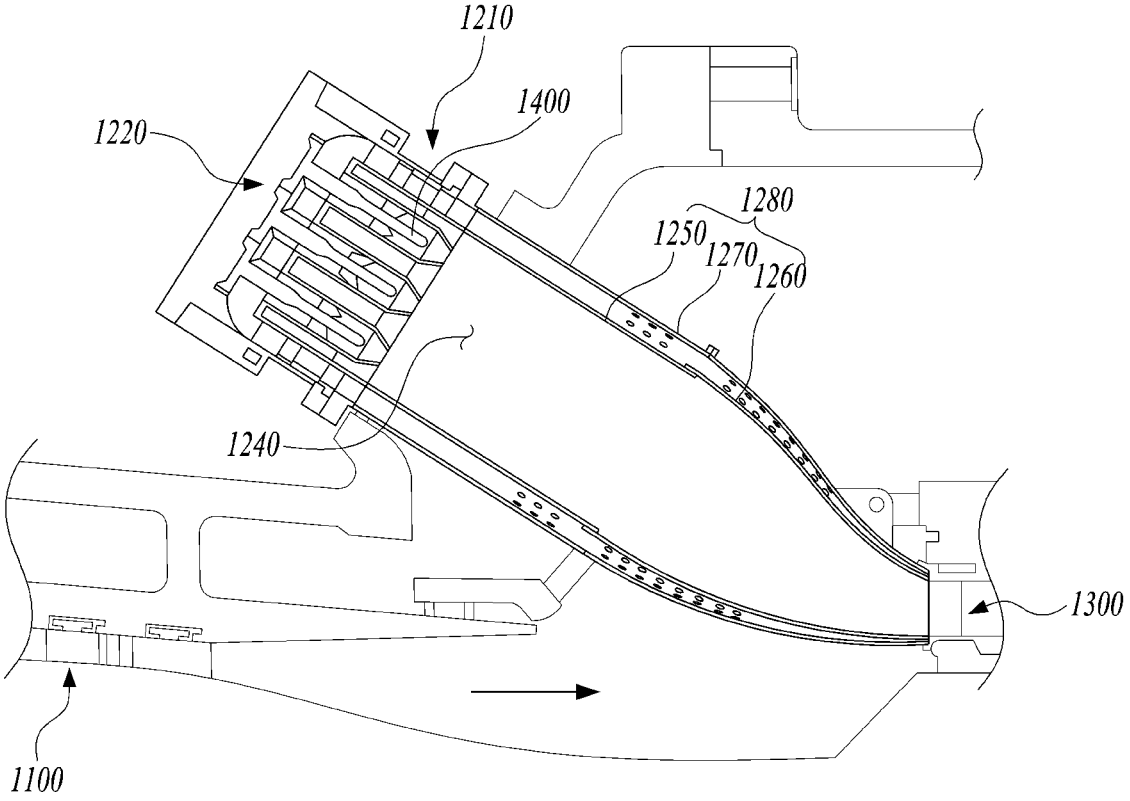
FIG. 2 is a view illustrating the combustor of FIG. 1.

FIG. 1 is a view illustrating an interior of a gas turbine according to a first exemplary embodiment. FIG. 2 is a view illustrating the combustor of FIG. 1.

The thermodynamic cycle of the gas turbine 1000 according to the exemplary embodiment may ideally comply with the Brayton cycle. The Brayton cycle consists of four processes including isentropic compression (i.e., an adiabatic compression) process, isobaric heat addition process, isentropic expansion (i.e., an adiabatic expansion) process, and isobaric heat dissipation process. In other words, in the Brayton cycle, thermal energy may be released by combustion of fuel in an isobaric environment after the atmospheric air is sucked and compressed to a high pressure, hot combustion gas may be expanded to be converted into kinetic energy, and exhaust gas with residual energy may be discharged to the atmosphere. As such, the Brayton cycle consists of four processes including compression, heating, expansion, and exhaust.

The gas turbine 1000 embodying the Brayton cycle may include a compressor 1100, a combustor 1200, and a turbine 1300, as illustrated in FIG. 1. Although the following description is given with reference to FIG. 1, the present disclosure may be widely applied to a gas turbine having the same configuration equivalent to that of the gas turbine 1000 illustrated in FIG. 1.

Referring to FIG. 1, the compressor 1100 of the gas turbine 1000 may suck air from the outside and compress the air. The compressor 1100 may supply the air compressed by compressor blades 1130 to the combustor 1200, and also supply cooling air to a high-temperature region required for cooling in the gas turbine 1000. In this case, because the drawn air is compressed in the compressor 1100 through an adiabatic compression process, the pressure and temperature of the air passing through the compressor 1100 increases.

The compressor 1100 may be designed in the form of a centrifugal compressor or an axial compressor. In general, the centrifugal compressor is applied to a small gas turbine, whereas a multistage axial compressor is applied to the large gas turbine 1000 as illustrated in FIG. 1 to compress a large amount of air. In the multistage axial compressor 1100, the compressor blades 1130 rotate along with rotation of rotor disks, compress introduced air, and transfer the compressed air to compressor vanes 1140 disposed at a following stage. The air is compressed gradually to a high pressure while passing through the compressor blades 1130 formed in a multistage structure.

The compressor vanes 1140 may be mounted to an inner surface of a housing 1150 in such a way that a plurality of compressor vanes 1140 form each stage. The compressor vanes 1140 guide the compressed air transferred from compressor blades 1130 disposed at a preceding stage, to compressor blades 1130 disposed at a following stage. For example, at least some of the plurality of compressor vanes 1140 may be mounted so as to be rotatable within a predetermined range, e.g., to adjust the inflow rate of air.

The compressor 1100 may be driven using some of the power output from the turbine 1300. To this end, a rotary shaft of the compressor 1100 may be directly connected to a rotary shaft of the turbine 1300, as illustrated in FIG. 1. In the case of the large gas turbine 1000, almost half of the power generated by the turbine 1300 may be consumed to drive the compressor 1100. Accordingly, the overall efficiency of the gas turbine 1000 can be enhanced by directly increasing the efficiency of the compressor 1100.

The turbine 1300 includes a plurality of rotor disks 1310, a plurality of turbine blades radially arranged on each of the rotor disks 1310, and a plurality of turbine vanes. Each of the rotor disks 1310 has a substantially disk shape and has a plurality of grooves formed on an outer peripheral portion thereof. The grooves are each formed to have a curved surface so that the turbine blades are inserted into the grooves, and the turbine vanes are mounted in a turbine casing. The turbine vanes are fixed so as not to rotate and guide a flow direction of the combustion gas passing through the turbine blades. The turbine blades generate rotational force while rotating by the combustion gas.

The combustor 1200 may mix the compressed air supplied from an outlet of the compressor 1100 with fuel through an isobaric combustion process to produce combustion gas with high energy. FIG. 2 illustrates an example of the combustor 1200 applied to the gas turbine 1000. The combustor 1200 may include a combustor casing 1210, a burner 1220, a nozzle 1400, and a duct assembly 1280.

The combustor casing 1210 may have an approximately cylindrical shape to surround a plurality of burners 1220. The burners 1220 may be disposed along the annular combustor casing 1210 downstream of the compressor 1100. Each of the burners 1220 includes a plurality of nozzles 1400, and the fuel injected from the nozzles 1400 is mixed with air at an appropriate rate to form the mixture having conditions suitable for combustion.

The gas turbine 1000 may use gas fuel, liquid fuel, or composite fuel formed by a combination thereof. It is important to make a combustion environment suitable for reducing an amount of exhaust gas such as carbon monoxide or nitrogen oxide. Accordingly, a premixed combustion scheme has been used increasingly because a combustion temperature can be reduced and uniform combustion is possible so that exhaust gas can be reduced, even though it is difficult to control the premixed combustion.

In the premixed combustion, compressed air is mixed with the fuel ejected from the nozzles 1400 in advance, and then enters a combustion chamber 1240. When combustion is stabilized after premixed gas is initially ignited by an igniter, the combustion is maintained by supplying fuel and air.

Referring to FIG. 2, compressed air flows along an outer surface of the duct assembly 1280, which connects an associated one of the burners 1220 to the turbine 1300 so that high-temperature combustion gas flows through the duct assembly 1280, and then is supplied to the nozzles 1400. In this process, the duct assembly 1280 heated by high-temperature combustion gas is properly cooled.

The duct assembly 1280 may include a liner 1250, a transition piece 1260, and a flow sleeve 1270. The duct assembly 1280 has a double-shell structure in which the flow sleeve 1270 surrounds the liner 1250 and the transition piece 1260. The liner 1250 and the transition piece 1260 are cooled by the compressed air permeated into an annular space within the flow sleeve 1270.

The liner 1250 is a tubular member connected to the burner 1220 of the combustor 1200, and the combustion chamber 1240 is an internal space of the liner 1250. The liner 1250 has one longitudinal end coupled to the burner 1220 and the other longitudinal end coupled to the transition piece 1260.

The transition piece 1260 is connected to an inlet of the turbine 1300 and serves to guide high-temperature combustion gas to the turbine 1300. The transition piece 1260 has one longitudinal end coupled to the liner 1250 and the other longitudinal end coupled to the turbine 1300. The flow sleeve 1270 serves to protect the liner 1250 and the transition piece 1260 and to prevent high-temperature heat from being directly released to the outside.

Figure 3:
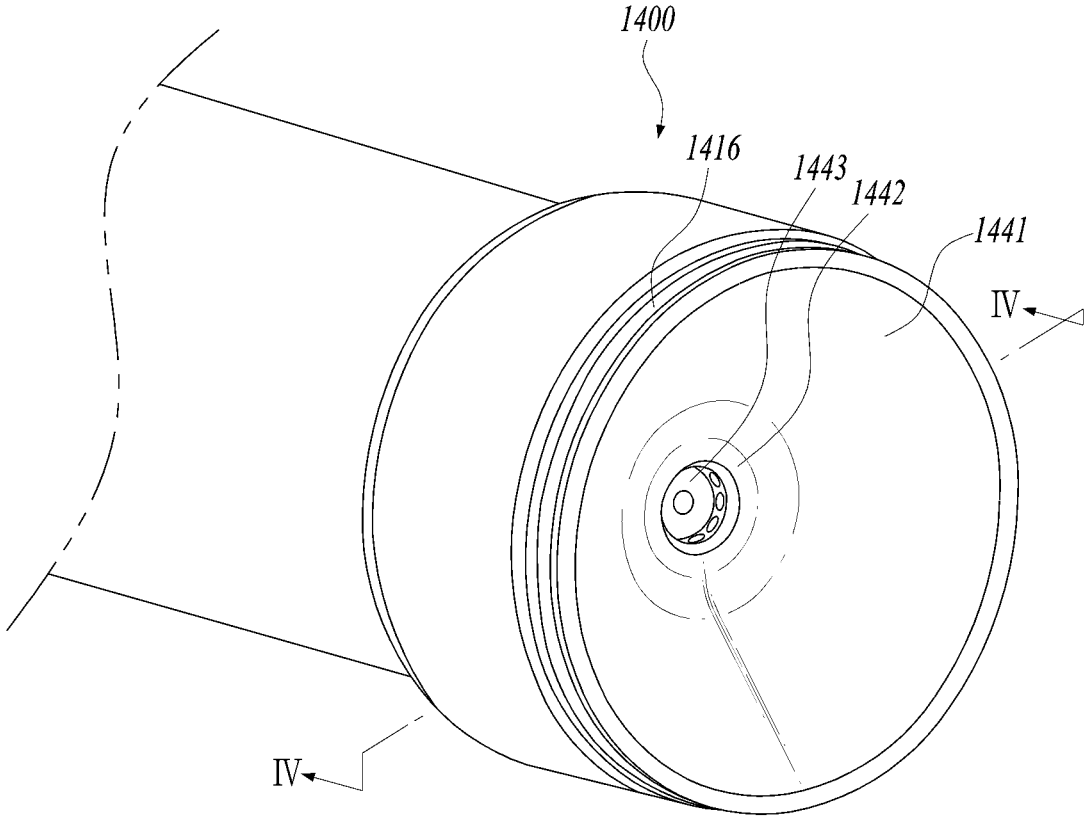
FIG. 3 is a perspective view illustrating one nozzle according to the first exemplary embodiment.
Figure 4:
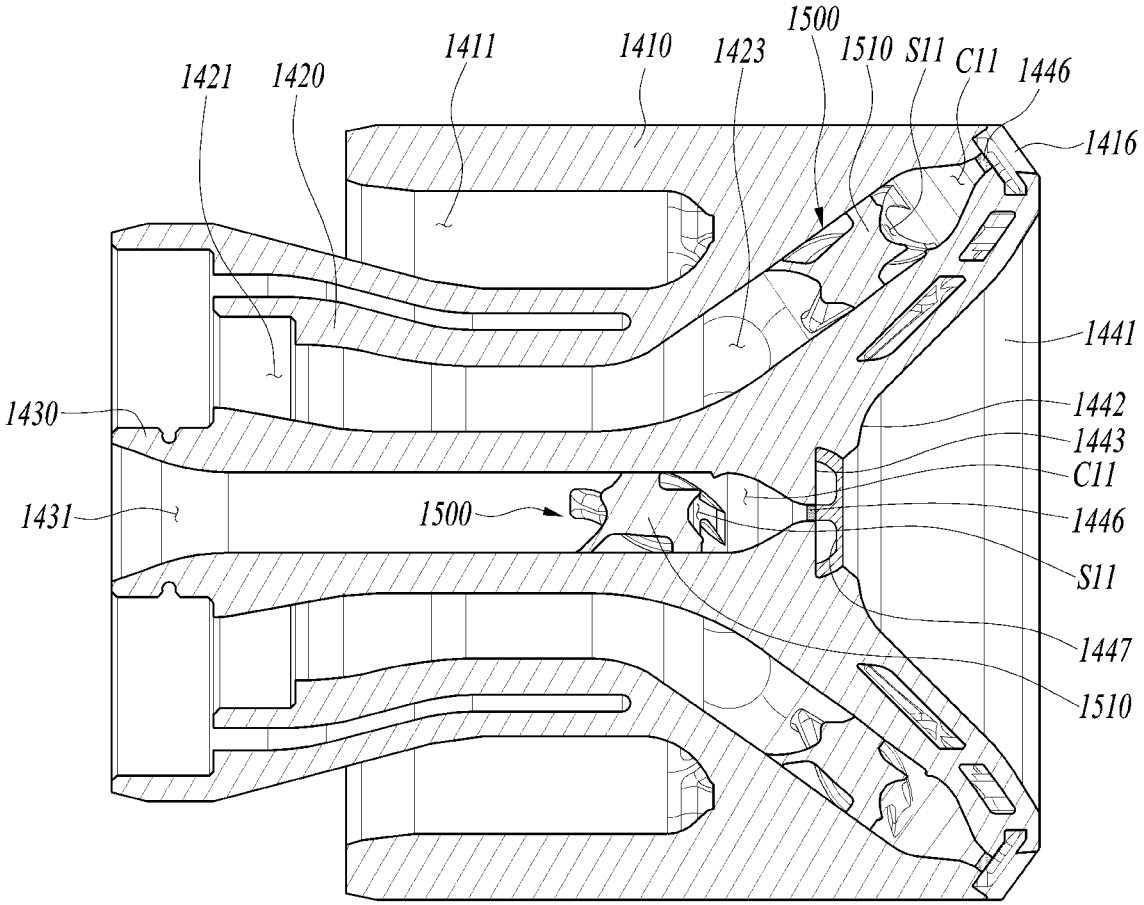
FIG. 4 is a cross-sectional view taken along line IV-IV of FIG. 3.

FIG. 3 is a perspective view illustrating one nozzle according to the first exemplary embodiment. FIG. 4 is a cross-sectional view taken along line IV-IV of FIG. 3.

Referring to FIGS. 3 and 4, each nozzle 1400 includes an outer tube 1410, a first inner tube 1420, a second inner tube 1430, a fuel injection device 1500, and a flow guide 1510.

The outer tube 1410 is formed of a substantially circular tube and has an internal space. A shroud (not shown) configured to enclose the outer tube 1410 may be installed to guide the flow of air.

The first inner tube 1420 configured to be inserted into the outer tube 1410 may be installed in a coaxial structure with the outer tube 1410. The first inner tube 1420 forms an air passage 1411 with the outer tube 1410 therebetween. The first inner tube 1420 is formed of a circular tube and has an internal space. The second inner tube 1430 configured to be inserted into the first inner tube 1420 may be installed in a coaxial structure with the first inner tube 1420. The second inner tube 1430 forms a main fuel passage 1421 with the first inner tube 1420 therebetween. The second inner tube 1430 may be formed of a circular tube, and a pilot fuel passage 1431 may be formed therein.

The main fuel passage 1421 may be supplied with mixed fuel in the form of emulsion in which water and fuel are mixed, and the pilot fuel passage 1431 may be supplied with liquid fuel. In this case, the fuel may be made of light oil, but the present disclosure is not limited thereto.

The nozzle 1400 includes, at a tip thereof, an inclined part 1441 recessed rearward (based on the flow direction of fuel), a flat part 1442 connected to a lower end of the inclined part 1441 and having a flat surface, a groove part 1443 recessed from the flat part 1442, and a curtain hole 1447 formed on a side of the groove part 1443 to inject air therethrough. In addition, an injection hole 1446 is formed in a bottom of the groove part 1443. An injection slot 1416 connected to the main fuel passage 1421 is formed outside the tip of the nozzle 1400. The injection slot 1416 may be connected in the circumferential direction of the nozzle 1400.

The main fuel passage 1421 may be connected to an injection passage 1423 connected to the outside of the nozzle 1400. The injection hole 1446 through which fuel is sprayed is formed at a tip of the injection passage 1423. The fuel injection device 1500 for atomizing fuel may be installed in the injection passage 1423. The fuel injection device 1500 may be formed on the tip of the injection passage 1423 to inject the atomized fuel through the injection hole 1446.

The injection hole 1446 is connected to the injection slot 1416 to inject fuel. The injection slot 1416 may be connected to a plurality of injection holes 1446 in some cases. A mixing space MS1 may be defined between the injection slot 1416 and the injection hole 1446, and air flowing out of the air passage 1411 may be supplied to the mixing space MS1. The atomized fuel and air are mixed in the mixing space MS1 and sprayed through the injection slot 1416. The mixing space MS1 may be connected in the circumferential direction of the nozzle 1400.

Alternatively, the fuel injection device 1500 for atomizing fuel may be installed in the pilot fuel passage 1431. The fuel injection device 1500 may inject the atomized fuel through the injection hole 1446.

The fuel injected from the injection hole 1446 is introduced into the groove part 1443, mixed with the air injected from the curtain hole 1447, and then discharged forward. While air is sprayed through the curtain hole 1447, the air helps to atomize the fuel as well as maintain a pressure difference between the inside and the outside of the main fuel passage 1421 and prevents backflow of flames or combustion gas.

Figure 5:
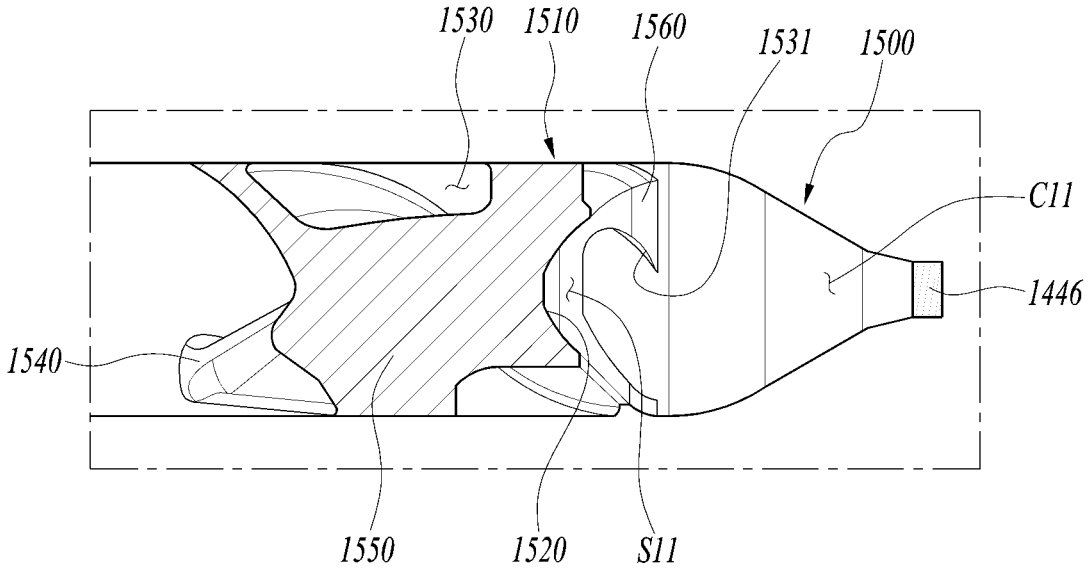
FIG. 5 is a view illustrating a fuel injection device disposed at a center of the nozzle according to the first exemplary embodiment.
Figure 6:
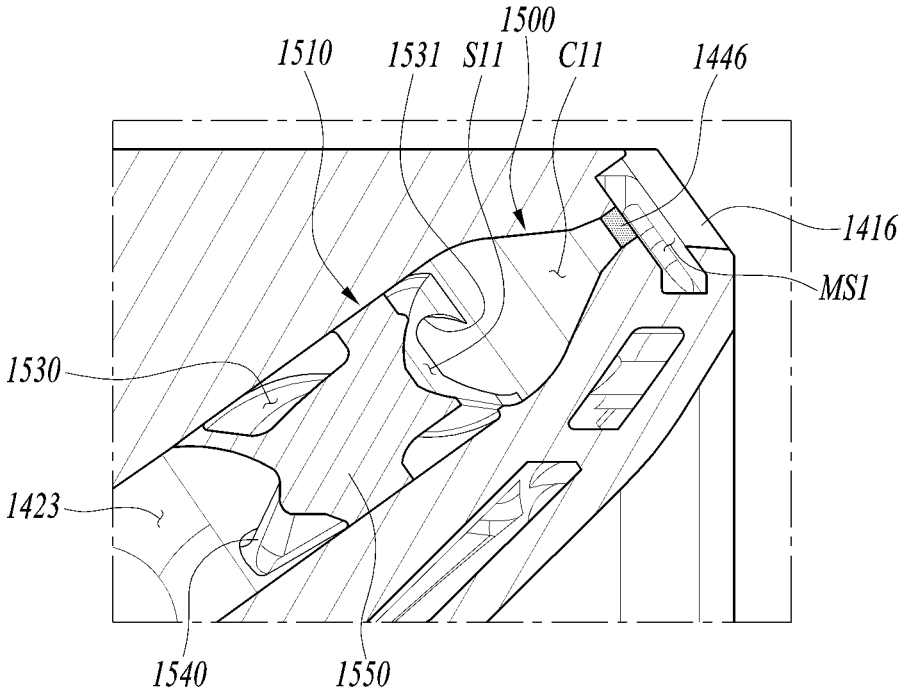
FIG. 6 is a view illustrating a fuel injection device disposed outside the nozzle according to the first exemplary embodiment.
Figure 7:
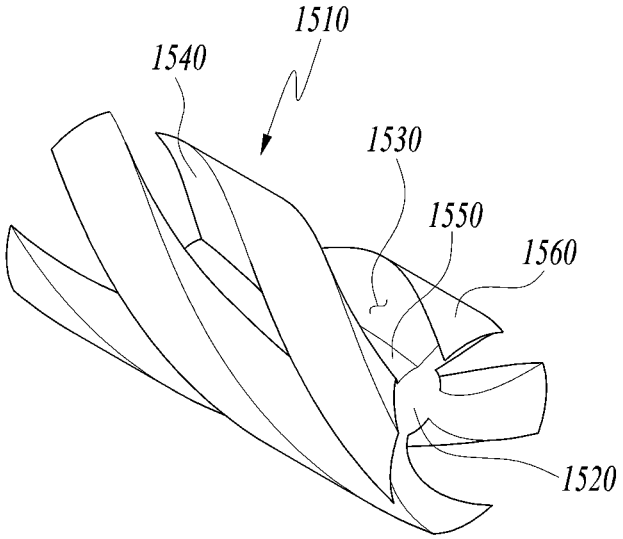
FIG. 7 is a perspective view illustrating a flow guide according to the first exemplary embodiment.
Figure 8:
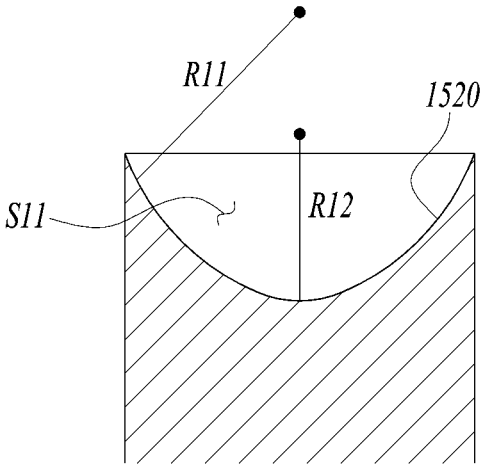
FIG. 8 is a view illustrating a decompression space according to the first exemplary embodiment.

FIG. 5 is a view illustrating the fuel injection device 1500 disposed at the center of the nozzle 1400 according to the first exemplary embodiment. FIG. 6 is a view illustrating the fuel injection device 1500 disposed outside the nozzle 1400 according to the first exemplary embodiment. FIG. 7 is a perspective view illustrating the flow guide 1510 according to the first exemplary embodiment. FIG. 8 is a view illustrating a decompression space according to the first exemplary embodiment.

Referring to FIGS. 5 to 8, the fuel injection device 1500 includes a guide channel 1530, an injection chamber C11, the injection hole 1446, the flow guide 1510, and a decompression space S11. The fuel injection device 1500 may be located at a center of the nozzle 1400. Additionally or alternatively, the fuel injection device 1500 may be located in front of the nozzle 1400.

In some cases, a plurality of fuel injection devices may be circumferentially spaced apart from each other in front of the injection passage 1423, and one fuel injection device 1500 may be installed in front of the pilot fuel passage 1431.

The guide channel 1530 may be formed between the flow guide 1510 and the injection passage 1423, and may also or alternatively be formed between the flow guide 1510 and the pilot fuel passage 1431. The guide channel 1530 may be spirally connected in the circumferential direction of the flow guide 1510 to guide fuel to form a swirl. The guide channel 1530 may have an outlet(s) 1531 formed at the tip thereof to discharge fuel therethrough, and the outlet 1531 may be inclined with respect to the longitudinal direction of the flow guide 1510.

The injection chamber C11 is connected to the guide channel 1530 and located in front of the guide channel 1530 to accommodate the fuel delivered from the guide channel 1530. The injection chamber C11 has an inner diameter that gradually decreases toward the front thereof.

The decompression space S11 is located at a rear of the injection chamber C11 and serves to increase the flow rate of fuel by partially lowering the pressure in the injection chamber C11. The injection hole 1446 may be formed at the tip of the injection chamber C11, and fuel may be sprayed through the injection hole 1446.

The flow guide 1510 includes a rod-shaped body 1550 and a spiral protrusion 1560 protruding from the body 1550 and connected in a spiral form. The body 1550 may have a cylindrical shape. The spiral protrusion 1560 has a width that gradually increases from the inside to the outside of the flow guide 1510. In addition, the tip of the spiral protrusion 1560 protrudes further forward from the body 1550, and the spiral protrusion 1560 has an outer end formed to protrude further forward front an inner end. Accordingly, the outlet 1531 may also have an outer side formed to protrude further forward from its inner side. The tip of the spiral protrusion 1560 and the outlet 1531 may have a curved structure.

The spiral protrusion 1560 may include a tail protrusion 1540 protruding further rearward from the body 1550, and the tail protrusion 1540 may guide fuel to flow into the guide channel 1530, thereby stably forming a swirl.

The decompression space S11 may be in the form of a curved arc at the tip of the flow guide 1510. Accordingly, the decompression space S11 may be located between the outlets 1531, and the pressure between the outlets 1531 may be dropped to increase the flow rate of fuel. The decompression space S11 may be a groove 1520. Because fuel is injected forward, the decompression space S11 located between the outlets 1531 is maintained at a relatively low pressure. Accordingly, the fuel may flow quickly into a low pressure area so that the flow rate of the fuel increases.

The decompression space S11 has an outer radius of curvature R11 that is larger than an inner radius of curvature R12. Accordingly, the inside of the decompression space S11 is deeper compared to other regions, resulting in a larger pressure drop toward the center of the flow guide 1510. Therefore, it is possible to further increase the flow rate of fuel. The decompression space S11 may have a cross section which is a part of an ellipse, and the cross section of the decompression space S11 may have a shape of a portion adjacent to the major axis in the ellipse.

As described above, according to the first exemplary embodiment, because the decompression space S11 is defined in the injection chamber C11 connected to the guide channel 1530, it is possible to increase the flow rate of fuel injected from the injection hole 1446 having the same diameter. If the flow rate of fuel increases, the diameter of the injection hole 1446 may be relatively decreased. If the diameter of the injection hole 1446 is decreased, it is possible to further atomize fuel particles.

Figure 9:
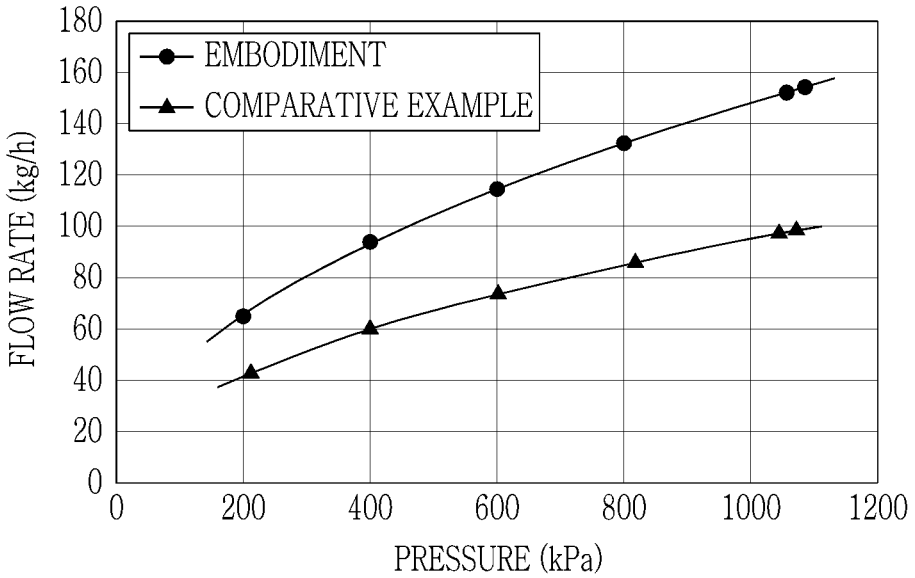
FIG. 9 is a graph illustrating a pressure versus flow rate relationship of the fuel injection device according to the first exemplary embodiment.

FIG. 9 is a graph illustrating a pressure versus flow rate relationship of the fuel injection device according to the first exemplary embodiment. FIG. 9 illustrates a fuel injection pressure versus flow rate change in the fuel injection device 1500 according to the first exemplary embodiment and a fuel injection device of a comparative example having the same configuration as the first exemplary embodiment except that the tip of the flow guide is flat. As illustrated in FIG. 9, it can be seen that the fuel injection device 1500 according to the first exemplary embodiment has a significantly higher flow rate of fuel per unit time compared to the comparative example. Therefore, a large amount of fuel can be supplied at a low supply pressure, and it is possible to atomize fuel more efficiently by reducing the diameter of the injection hole 1446.

Figure 10:
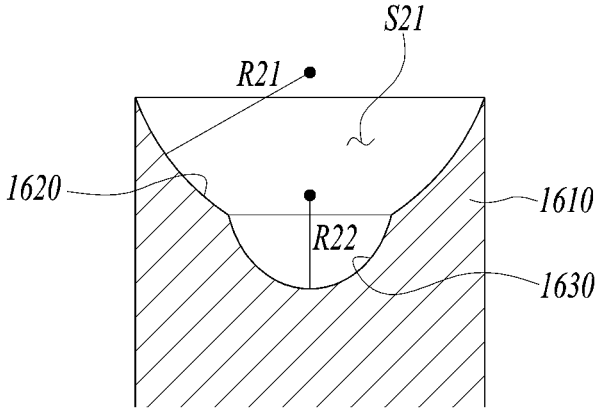
FIG. 10 is a view illustrating a decompression space according to a second exemplary embodiment.

Hereinafter, a fuel injection device according to a second exemplary embodiment will be described. FIG. 10 is a view illustrating a decompression space according to a second exemplary embodiment.

Here, because the fuel injection device according to the second exemplary embodiment has the same structure as the fuel injection device according to the first exemplary embodiment except for the decompression space, a redundant description will be omitted.

Referring to FIG. 10, the decompression space S21 may be defined in the form of a curved arc at the tip of a flow guide 1610. The decompression space S21 may be defined by a first groove 1620 having a first radius of curvature R21 and a second groove 1630 having a second radius of curvature R22. The first groove 1620 may be located outward, and the second groove 1630 may be located at the center of the first groove 1620. Here, the first radius of curvature R21 may be larger than the second radius of curvature R22. If the decompression space S21 is defined by the first and second grooves 1620 and 1630, the central region of the decompression space S21 can be maintained at a lower pressure to further increase the flow rate of fuel.

Figure 11:
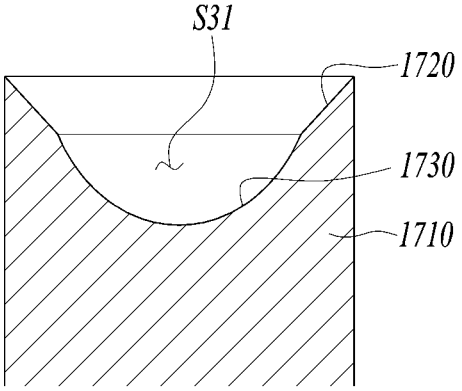
FIG. 11 is a view illustrating a decompression space according to a third exemplary embodiment.

Hereinafter, a fuel injection device according to a third exemplary embodiment will be described. FIG. 11 is a view illustrating a decompression space according to a third exemplary embodiment.

Here, because the fuel injection device according to the third exemplary embodiment has the same structure as the fuel injection device according to the first exemplary embodiment except for the decompression space, a redundant description will be omitted.

Referring to FIG. 11, the decompression space S31 may be defined at a front end of a flow guide 1710 by a first groove 1720 having an inclined surface and a second groove 1730 in the form of a curved arc. The first groove 1720 may be located outward, and the second groove 1730 may be located at the center of the first groove 1720.

The first groove 1720 may have the inclined surface with respect to the longitudinal direction of the flow guide 1710 and may have a truncated cone shape whose cross-sectional area decreases rearward. On the other hand, the second groove 1730 may be a hemisphere or part of a sphere. In addition, the second groove 1730 may be a cross section which is an arc or part of an ellipse.

If the decompression space S31 is defined by the two-stage grooves 1720 and 1730, the central region of the decompression space S31 can be maintained at a lower pressure to further increase the flow rate of fuel.

As described above, the fuel injection device, the nozzle, and the combustor according to one or more exemplary embodiments, because the decompression space which enables an increase in the flow rate of fuel and a decrease in the inner diameter of the injection hole is defined, it is possible to atomize fuel efficiently.

While one or more exemplary embodiments have been described with reference to the accompanying drawings, it will be apparent to those skilled in the art that various variations and modifications may be made by adding, changing, or removing components without departing from the spirit and scope of the disclosure as defined in the appended claims, and these variations and modifications fall within the spirit and scope of the disclosure as defined in the appended claims.

What is claimed is:

1. A fuel injection device for a combustor comprising:

a flow guide comprising a rod-shaped body and a plurality of protrusions protruding outwardly from the rod-shaped body;

a plurality of guide channels connected to a pilot fuel passage through which fuel is supplied, each guide channel being formed between two adjacent protrusions of the plurality of protrusions, outward ends of the two adjacent protrusions being circumferentially spaced apart from each other;

an injection chamber connected to the plurality of guide channels, the fuel being merged in the injection chamber; and an injection hole formed at a tip of the injection chamber to inject the fuel, wherein the injection chamber comprises a decompression space to drop a pressure therein, wherein each guide channel has an outlet formed at a protrusion tip, each protrusion tip of each protrusion protrudes forward gradually outwards, such that the protrusion tip and the outlet have a curved structure, wherein the protrusion tip and the outlet connected with a groove of the rod-shaped body form the decompression space, wherein the protrusion comprises a tail protrusion protruding further rearward than a rearward end of the rod-shaped body, wherein the tail protrusion has a shape of a concave groove formed from a rearward end of the rod-shaped body to an outward end of the tail protrusion, wherein forward and rear directions are viewed in an upstream direction with respect to a flow of the fuel through the plurality of guide channels along a longitudinal direction of the flow guide.

2. The fuel injection device according to claim 1, wherein the plurality of guide channels have the outlets connected to the injection chamber, and the decompression space is located between the outlets.

3. The fuel injection device according to claim 2, wherein the plurality of protrusions and the plurality of guide channels are in a spiral form.

4. The fuel injection device according to claim 1, wherein each protrusion has a width in a circumferential direction that gradually increases outward.

5. The fuel injection device according to claim 1, wherein the decompression space is defined at the protrusion tip.

6. The fuel injection device according to claim 1, wherein the decompression space is in a form of a curved arc.

7. The fuel injection device according to claim 1, wherein the decompression space has a cross section which is part of an ellipse.

8. The fuel injection device according to claim 2, wherein each of the outlets is inclined with respect to the longitudinal direction of the flow guide.

9. The fuel injection device according to claim 1, wherein the decompression space is defined by a first groove having a first radius of curvature and a second groove having a second radius of curvature smaller than the first radius of curvature, the second groove being formed at a center of the first groove.

10. The fuel injection device according to claim 1, wherein the decompression space is defined by a first groove having an inclined conical-like surface and a second groove in a form of a curved area, the second groove being formed at a center of the first groove.

11. The fuel injection device according to claim 1, wherein the decompression space is defined by the curved structure having a curved concave groove, the curved concave groove having a larger outer radius of curvature than an inner radius of curvature, wherein each protrusion tip of the plurality of protrusions has a shape of the curved concave groove and remains the shape of the curved concave groove from a forward end of the rod-shaped body to an outward end of each protrusion tip.

12. The fuel injection device according to claim 1, wherein the plurality of protrusions are extended from the rod-shaped body to an inner surface of the pilot fuel passage, such that the fuel, which flows from the pilot fuel passage to the injection chamber, exclusively flows through the plurality of guide channels.

13. A combustor nozzle comprising:

an outer tube;

a first inner tube installed inside the outer tube to form an air passage with the outer tube therebetween;

a second inner tube installed inside the first inner tube to form a main fuel passage with the first inner tube therebetween, the second inner tube having a pilot fuel passage formed therein; and a fuel injection device installed in the second inner tube to inject fuel, wherein the fuel injection device comprises:

a flow guide comprising a rod-shaped body and a plurality of protrusions protruding outwardly from the rod-shaped body;

a plurality of guide channels connected to the pilot fuel passage through which the fuel is supplied, each guide channel being formed between two adjacent protrusions of the plurality of protrusions, outward ends of the two adjacent protrusions being circumferentially spaced apart from each other;

an injection chamber connected to the plurality of guide channels, the fuel being merged in the injection chamber; and an injection hole formed at a tip of the injection chamber to inject the fuel, and wherein the injection chamber comprises a decompression space to drop a pressure therein, wherein each guide channel has an outlet formed at a protrusion tip, each protrusion tip of each protrusion protrudes forward gradually outwards, such that the protrusion tip and the outlet have a curved structure, wherein the protrusion tip and the outlet connected with a groove of the rod-shaped body form the decompression space, wherein the protrusion comprises a tail protrusion protruding further rearward than a rearward end of the rod-shaped body, wherein the tail protrusion has a shape of a concave groove formed from a rearward end of the rod-shaped body to an outward end of the tail protrusion, wherein forward and rear directions are viewed in an upstream direction with respect to a flow of the fuel through the plurality of guide channels along a longitudinal direction of the flow guide.

14. The combustor nozzle according to claim 13, wherein the plurality of guide channels have the outlets connected to the injection chamber, and the decompression space is located between the outlets.

15. The combustor nozzle according to claim 13, wherein the plurality of protrusions and the plurality of guide channels are in a spiral form.

16. A combustor comprising:

a burner including a plurality of nozzles for injecting fuel and air; and a duct assembly coupled to one side of the burner to burn a mixture of the fuel and the air and transmit combustion gas to a turbine, wherein each of the plurality of nozzles comprises:

an outer tube;

a first inner tube installed inside the outer tube to form an air passage with the outer tube therebetween;

a second inner tube installed inside the first inner tube to form a main fuel passage with the first inner tube therebetween, the second inner tube having a pilot fuel passage formed therein; and a fuel injection device installed in the second inner tube to inject the fuel, wherein the fuel injection device comprises:

a flow guide comprising a rod-shaped body and a plurality of protrusions protruding outwardly from the rod-shaped body;

a plurality of guide channels connected to the pilot fuel passage through which the fuel is supplied, each guide channel being formed between two adjacent protrusions of the plurality of protrusions, outward ends of the two adjacent protrusions being circumferentially spaced apart from each other;

an injection chamber connected to the plurality of guide channels, the fuel being merged in the injection chamber; and an injection hole formed at a tip of the injection chamber to inject the fuel, and wherein the injection chamber comprises a decompression space to drop a pressure therein, wherein each guide channel has an outlet formed at a protrusion tip, each protrusion tip of each protrusion protrudes forward gradually outwards, such that the protrusion tip and the outlet have a curved structure, wherein the protrusion tip and the outlet connected with a groove of the rod-shaped body to form the decompression space, wherein the protrusion comprises a tail protrusion protruding further rearward than a rearward end of the rod-shaped body, wherein the tail protrusion has a shape of a concave groove formed from a rearward end of the rod-shaped body to an outward end of the tail protrusion, wherein forward and rear directions are viewed in an upstream direction with respect to a flow of the fuel through the plurality of guide channels along a longitudinal direction of the flow guide.

17. The combustor according to claim 16, wherein the plurality of guide channels have the outlets connected to the injection chamber, and the decompression space is located between the outlets.

18. The combustor nozzle according to claim 16, wherein the plurality of protrusions and the plurality of guide channels are in a spiral form.

* * * * *